United States Patent [19]

Reeves

[11] Patent Number: 4,459,081

[45] Date of Patent: Jul. 10, 1984

[54] SPEED REDUCING MAST TILT INDICATOR

[75] Inventor: Jerry L. Reeves, Dallas, Oreg.

[73] Assignee: Cameron Iron Works, Inc., Houston, Tex.

[21] Appl. No.: 375,111

[22] PCT Filed: Mar. 8, 1982

[86] PCT No.: PCT/US82/00297

§ 371 Date: Mar. 8, 1982

§ 102(e) Date: Mar. 8, 1982

[87] PCT Pub. No.: WO83/03089

PCT Pub. Date: Sep. 15, 1983

[51] Int. Cl.[3] ..... B66F 9/20

[52] U.S. Cl. ..... 414/636; 91/1; 91/27; 91/31

[58] Field of Search ..... 414/635, 636; 91/1, 91/27, 31, 410; 212/161

[56] References Cited

U.S. PATENT DOCUMENTS 3,386,603 6/1968 Rueb .
3,530,766 9/1970 Pilch ..... 212/161 X
3,591,030 7/1971 Pachter .
4,093,091 6/1978 Gregg et al. .

*Primary Examiner*—Robert G. Sheridan
*Attorney, Agent, or Firm*—Vinson & Elkins

[57] ABSTRACT

The operator of a lift truck or other load supporting vehicle (11) having a tiltable mast (12, 12*a*) is alerted as the mast (12, 12*a*) tilts beyond a predetermined orientation by a temporarily slowing of the rate of tilting movement. Return motion of the mast (12, 12*a*) may be unimpeded. The operator is reliably made aware when the mast (12, 12*a*) reaches a predetermined limit but may continue the tilting motion when that is necessary for such purposes as traveling the vehicle (11) under overhead obstructions. In systems where the mast (12, 12*a*) is tilted by fluid motors (20, 20*a*), the automatic tilt speed reduction may be realized with a valve (33, 33*a*) which temporarily introduces a one way flow restriction (49) into the fluid flow path (28, 28*a*) between the motors (20, 20*a*) and pressurized fluid source (27, 27*a*), the valve (33, 33*a*) being actuated by inclination sensing mechanism (23, 23*a*).

8 Claims, 6 Drawing Figures

12
11
16
17
18
19
20
21
14
13

SPEED REDUCING MAST TILT INDICATOR

DESCRIPTION

1. Technical Field

This invention relates generally to vehicles which have a tiltable mast for supporting and carrying loads and more particularly to apparatus which informs the vehicle operator when the mast arrives at a predetermined inclination.

2. Background Art

The mast of a lift truck or the like is usually more or less upright as a load is being received or deposited and is tilted backward towards the body of the vehicle, to retain the load, during load carrying operations. Inadvertent forward tilting of the mast beyond a few degrees from vertical during load carrying operations can cause a loss of the load from the forks or other load engaging components. Stability of the vehicle may be adversely affected particularly if there is a substantial amount of forward tilt at a time when a load is being supported at an elevated location along the mast.

Accordingly, it has been a common practice to provide tilt motion limiting mechanisms of various kinds on lift trucks or the like to stop forward tilting of the mast at a position slightly past vertical such as at three degrees of forward tilt, for example. These may variously be mechanical stops or mechanisms which stop operation of the fluid motors that are typically used to tilt the mast.

There are circumstances under which a substantial degree of forward tilting of the mast may be desirable or even necessary. Forward tilting of the mast may be needed to enable travel of the vehicle under a low overhead obstacle. Lowering of the mast by forward tilting may also be desirable when the vehicle is being towed or transported on the bed of a truck or other conveyance. Forward tilt may also be necessary in order to deposit loads at elevated locations, such as openings in stacks of containers, under some conditions. Instances where forward tilting of the mast may be necessary have become more common with the advent of so called rough terrain lift trucks which typically have high masts and which may be designed to operate on uneven surfaces such as at construction sites or the like.

In many prior lift truck constructions, of which the mechanism described in U.S. Pat. No. 3,386,603 of H. D. Rueb, issued June 4, 1968; is an example, forward tilting of the mast beyond the predetermined limit cannot be accomplished unless the operator stops the vehicle, dismounts and disconnects or removes elements of the tilt motion limiting mechanism. Operators may then inadvertently or deliberately fail to reconnect the motion limiting mechanism before resuming work operations. Consequently, there is no positive alerting of the operator when the normal limit of forward tilt is about to be exceeded during subsequent operations.

Providing of an override system with which the operator could optionally inactivate the forward tilt motion limiting mechanism would add substantial structural complication and the override system could itself be left activated either by accident or purposely in order to avoid a need for repeated actuations during subsequent work operations. Audible or visual indicators such as buzzers or indicator lamps for alerting the operator when the mast is tilted forwardly past a predetermined inclination are not a preferred solution in view of the large number of other audible and visual indicator devices which are typically present on a lift truck. Indicators of this kind require considerable maintenance and are also readily susceptible to intentional disconnection. It would be advantageous to use some other system to signal the operator when the mast enters the forward tilt range of movement.

The present invention is directed to overcoming one or more of the problems as set forth above.

DISCLOSURE OF THE INVENTION

In one aspect of the present invention, a load handling vehicle having a tiltable mast, means for supporting a load on the mast and motor means for tilting the mast between a first and a second position is further provided with speed reducing means for slowing tilting movement of the mast and inclination sensing means for detecting the inclination of the mast and actuating the speed reducing means in response to movement of the mast into a predetermined range of mast positions between the first and second positions.

The invention very reliably alerts the operator of a lift truck or the like when a load supporting mast reaches a predetermined inclination by a temporary slowing of the rate of tilting movement. The tilting of the mast may then be continued if that is desired without additional actions on the part of the operator such as disconnection or removal of motion limiting mechanisms. The apparatus is not susceptible to being inadvertently left in an inactivated condition and can be arranged to render deliberate inactivation extremely difficult. The apparatus may, if desired, be arranged to slow the rate of mast tilt only during forward tilting movement but not during the return movement of the mast through the same portion of the range of mast inclinations. This avoids delay in the return movement.

BEST MODES FOR CARRYING OUT THE INVENTION

Figure 1:
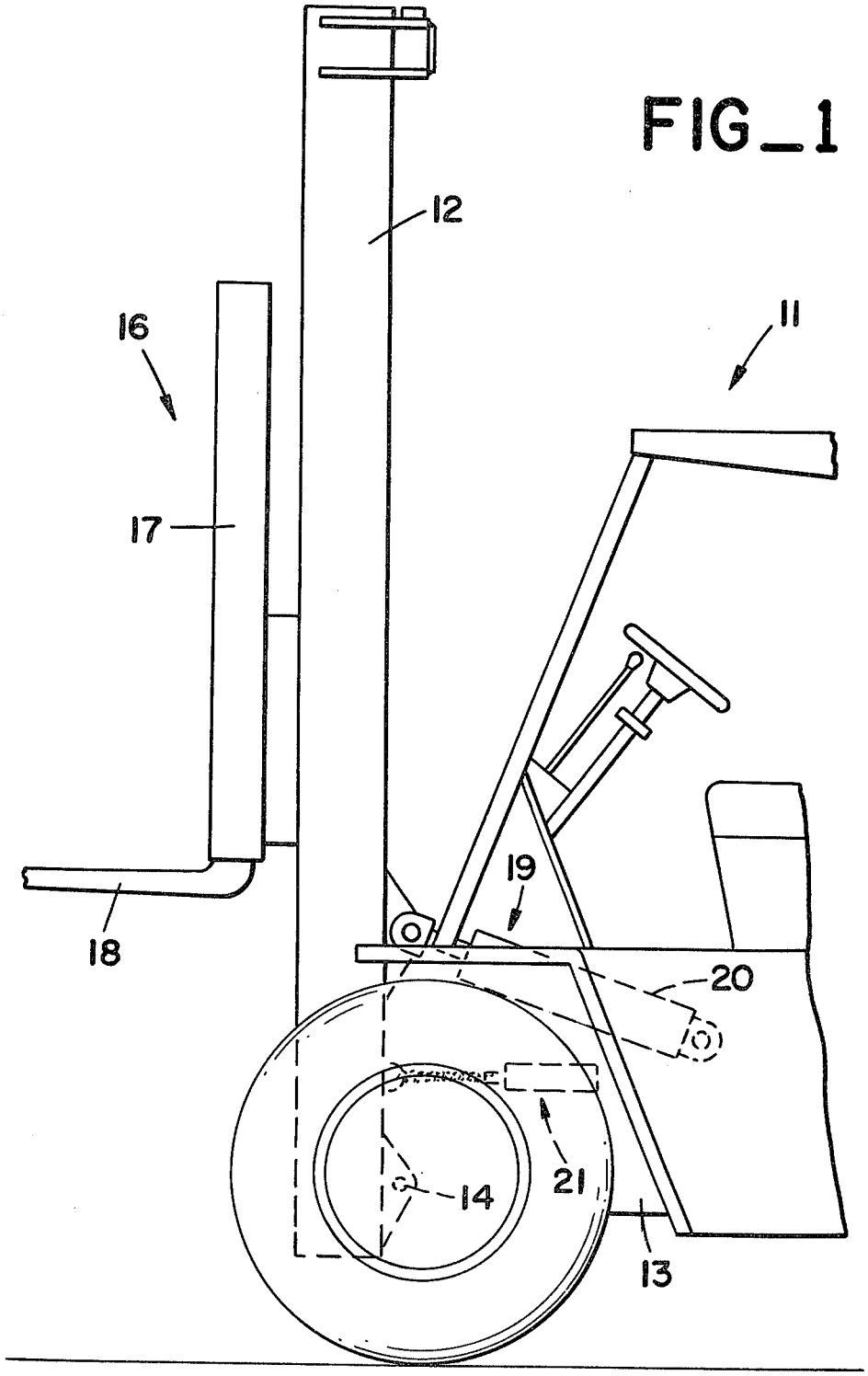
FIG. 1 is a side elevation view of the forward portion of an industrial lift truck equipped with a first embodiment of the present invention.

Referring initially to FIG. 1 of the drawings many load handling vehicles such as the industrial lift truck 11 of this embodiment have an upwardly extending mast 12 on which loads are supported. The mast 12 may be connected to the frame or body 13 of the vehicle through a pivot coupling 14 situated near the base of the mast to provide for tilting of the mast both forwardly and backwardly from the vertical orientation shown in the drawing. Means 16 for supporting a load on the mast 12 may take a variety of forms and in this example includes a carriage 17 with forwardly extending forks 18 for engaging a load, the carriage being vertically movable along the mast 12.

Motor means 19 for causing tilting movement of mast 12 in this embodiment include a pair of fluid operated extensible and retractable tilt cylinders 20 of which a single cylinder appears in FIG. 1, the cylinders being connected between the mast and body 13 of the vehicle. The fluid cylinders 20 may for example be sized to provide for a range of mast inclinations from about 12° of backward tilt to about 45° of forward tilt relative to vertical although these limits may be different in other vehicles. The mast 12 is not tilted forward beyond a few degrees during many load handling operations but the forward tilt capability is present to enable certain specialized operations such as lowering of the mast when that is necessary to travel the vehicle under overhead obstacles.

The detailed construction of the above described components of the lift truck 11, including such components as the mast 12, pivot coupling 14, carriage 17, forks 18 and tilt cylinders 20 may if desired be of known forms and accordingly need not be further described. In accordance with the present invention, the lift truck 11 is further provided with tilt indicator means 21 for alerting the operator when tilting motion moves the mast 12 into a predetermined portion of the range of mast inclinations by temporarily slowing the rate of tilting motion. In this embodiment means 21 slows the mast 12 motion as the mast tilts forwardly through the initial, 0° to 5°, part of the total 45° range of forward inclinations although the apparatus may be arranged to slow the rate of tilting at any other portion of the total range of inclinations as may be desirable in other load carrying vehicles.

Figure 2:
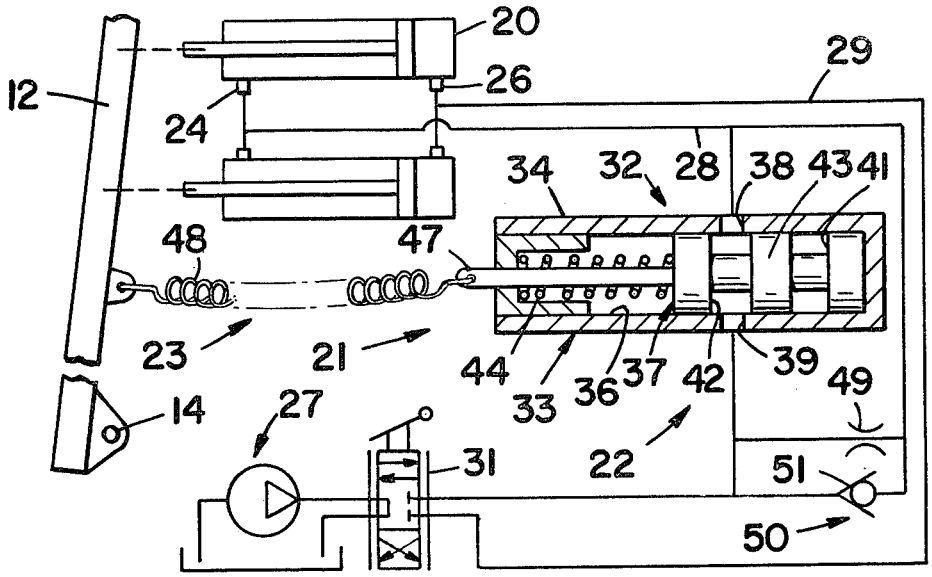
FIG. 2 is an axial section view of a tilt speed restrictor valve of the embodiment of the invention depicted in FIG. 1 further including certain associated fluid circuit elements which are shown in schematic form.

With reference to FIG. 2 the tilt indicator means 21 includes tilt speed reducing means 22 for temporarily slowing tilting movement of the mast 12 and inclination sensing means 23 for detecting the inclination of the mast and actuating the tilt speed reducing means in response to movement of the mast into a predetermined range of mast positions.

The rod end and head end ports 24 and 26 respectively of the tilt cylinders 20 are connected to a source of pressurized fluid 27 through flow lines 28 and 29 respectively and through control valve means 31 for transmitting pressurized fluid to a selected one of the flow lines while discharging fluid from the other flow line and which also provides for selective blocking of both flow lines to immobilize the cylinders 20 and thus the mast 12 when that is desired. The speed reducing means 22 in this embodiment includes flow reducing means 32 for reducing the rate of fluid flow between source 27 and tilt cylinders 20. In particular, a flow restrictor valve 33 is situated in flow line 28 to the rod ends of the cylinders 20 in this particular example.

The flow restrictor valve 33 of this particular embodiment of the invention has a housing 34 with a stepped bore 36 in which a valve spool 37 is disposed for axial movement. Valve ports 38 and 39 situated at opposite sides of the central region of bore 36 are communicated with motor ports 24 and control valve 31 respectively and in effect define a portion of the flow line 28 therebetween. Spool 37 has a pair of annular grooves 41 and 42 spaced apart by a central land 43. A spring 44 biases the spool towards a first spool position, depicted in FIG. 2, at which valve ports 38 and 39 are intercommunicated by spool groove 42. Spool 37 may be shifted axially in bore 36 to a second position, depicted in FIG. 3, at which the central land 43 blocks valve ports 38 and 39 and thus flow line 28 and may be shifted still further to a third position depicted in FIG. 4 at which the other spool groove 41 again intercommunicates the two valve ports. At the third position shown in FIG. 4, the spool abuts a step 46 in bore 36 which blocks further axial movement of the spool.

Referring again to FIG. 2, a valve actuator rod 47 extends from spool 37 out of housing 34 along the axis of bore 36 to provide for shifting of the spool between the above described positions.

The inclination sensing means 23 in this example of the invention includes a tension spring 48 connected between actuator rod 47 and mast 12. Tension spring 48 has a length sufficient to cause the spring to be relaxed when the mast 12 is tilted backwardly but to begin a state of tension as the mast reaches a vertical orientation. The spring constant of tension spring 48 is substantially greater than that of the internal biasing spring 44 of flow restrictor valve 33. Thus an initial amount of forward tilting of the mast 12 compresses the biasing spring 44 and moves spool 37 rather than significantly distending the tension spring 48. Consequently the initial portion of forward tilting of mast 12 shifts flow restrictor valve 33 to the second position and subsequently to the third position.

To provide a relatively restricted flow path between control valve 31 and the rod end ports 24 of fluid cylinders 20 when the flow restrictor valve 33 is at the second position, valve ports 38 and 39 are communicated through a flow restriction 49. In this example, restriction 49 is sized to reduce the rate of flow to about one fourth to one fifth of the rate of flow which occurs when valve 33 is open although other degrees of flow reduction may be used. In this embodiment, the temporary reduction of the rate of tilting of mast 12 is needed only when the mast is being tilted in the forward direction and it is preferable that the return motion of the mast not be slowed. For this purpose, means 50 are provided for preventing operation of the speed reducing means 22 during the return motion. In particular, a one way flow valve or check valve 51 is also connected between valve ports 38 and 39 in parallel relationship with the flow restriction 49. The check valve 51 is oriented to bypass fluid around the flow restriction 49 when the fluid flow is directed from control valve 31 to valve ports 24.

Figure 5:
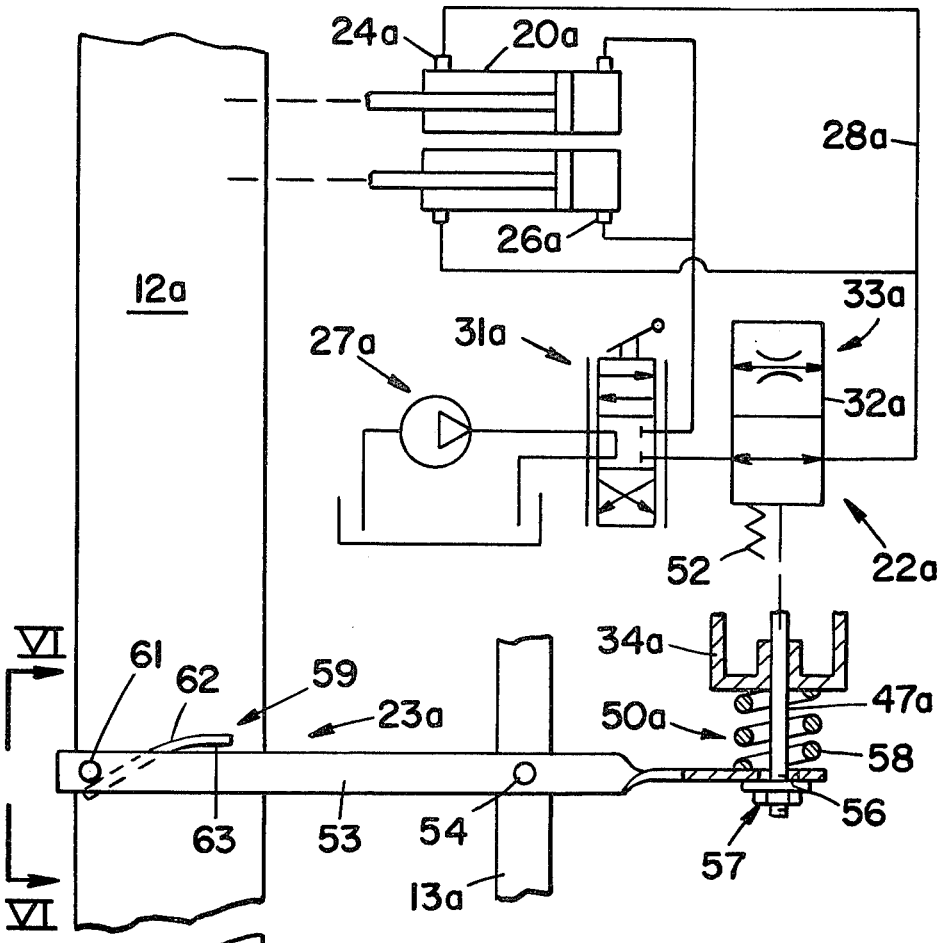
FIG. 5 is a diagrammatic view of an alternate embodiment of the present invention.
Figure 6:
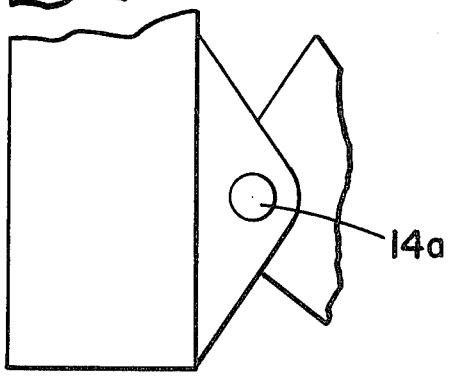
FIG. 6 is an elevation view of a portion of the structure of FIG. 5, taken along line VI—VI.
Figure 6:
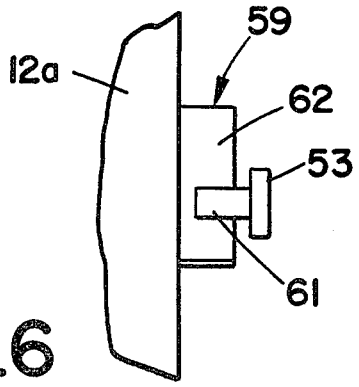

The flow restrictor valve 33 may have other specific forms while still accomplishing the above described functions. For example the flow restriction 49 and/or the check valve 51 may be built into central land 43 of valve spool 37 instead of being located elsewhere as depicted schematically in the drawings. The inclination sensing means 23 may also take other forms while accomplishing essentially similar functions. FIGS. 5 and 6 illustrate a second embodiment of the invention with modified components of these kinds.

More specifically and with reference to FIG. 5, the mast 12*a*, tilt cylinders 20*a*, pressurized fluid source 27*a* and control valve 31*a* may all be similar to the corresponding components of the first described embodiment. A modified flow restrictor valve 33*a* is present in the flow line 28*a* between control valve 31*a* and rod end ports 24*a* of tilt cylinders 20*a*. Flow restrictor valve 33*a*, in this second embodiment, is a two position valve having a first position providing an unrestricted flow path between control valve 31*a* and tilt cylinders 20*a* and having a second position at which the flow path is relatively restricted. An internal valve spring 52 biases flow restrictor valve 33*a* to the first or unrestricted position. The valve 33*a* has an actuator rod 47*a* which may be moved axially to shift the valve to the second or flow restricting position against the force of biasing spring 52.

The modified inclination sensing means 23*a* of the embodiment of FIG. 5 includes a lever 53 extending from one side of mast 12*a* to actuator rod 47*a* and which is pivoted at an intermediate point to the body 13*a* of the lift truck by a pivot coupling 54 which provides for pivoting movement of the lever in a vertical plane. Actuator rod 47*a* of flow restrictor valve 33*a* extends downwardly through an opening 56 in the back end of lever 53 and a threaded nut and washer 57 are engaged on the lower end of the actuator rod 47*a* immediately below the lever 53. Thus downward motion of the back end of the lever 53 will shift the flow restrictor valve 33*a* to the second or flow restricting position against the biasing force of the internal valve spring 52 and thereby slow the rate of extension of tilt cylinders 20*a*.

A compression spring 58 is disposed coaxially around valve actuator rod 47*a* between lever 53 and the underside of the housing 34*a* of flow restrictor valve 33*a*. Spring 58 has a smaller spring constant than the internal biasing spring 52 of flow restrictor valve 33*a* so that, in the absence of an additional force acting on the lever 53, the lever is held in the position depicted in FIG. 5 and the flow restrictor valve 33*a* remains at the first position. The valve 33*a* may be shifted to the second or flow restricting position by upward force acting on the end of lever 53 which is adjacent mast 12*a*.

Referring now to FIGS. 5 and 6 in conjunction, a cam plate 59 is secured to the side of mast 12*a* and a cam follower pin 61 extends sidewardly a short distance from the adjacent end of lever 53 in position to be contacted by the upper cam surface 62 as the mast 12*a* is tilted forwardly from a vertical orientation. The cam plate 59 slopes upwardly towards the back of mast 12*a* to force cam follower pin 61 upwardly as the mast 12*a* tilts forward from vertical. This pivots lever 53 to shift flow restrictor valve 33*a* to the second or flow restricting position. The upper cam surface 62 is of sufficient length to hold the cam follower pin 61 in the elevated position as the mast 12*a* tilts through an initial portion of the range of forward mast inclinations. In this example, cam 59 is sized and positioned to shift the valve 33*a* to the second or flow restricting position as the forwardly tilting mast 12*a* reaches the upright or 0° orientation and to hold the valve in that shifted position until the forward tilt of the mast passes 5° of forward tilt. As will be apparent, the cam 59 and follower 61 may be shaped and located to actuate the flow restrictor valve 33*a* during different portions of the range of mast inclinations where that is desirable.

INDUSTRIAL APPLICABILITY

In the operation of the first embodiment of the invention depicted in FIGS. 1 to 4, the speed reducing means 22 remains inactive during periods when the mast 12 is strictly upright or tilted backward towards the vehicle body 13. Under these conditions, tension spring 48 of the inclination sensing means 23 is relaxed sufficiently that the internal biasing spring 44 of flow restrictor valve 33 may hold spool 37 to the right as viewed in FIG. 2. At that position, the flow restrictor valve 33 provides an unrestricted flow path 28 via valve groove 42. Tilting of the mast 12 may proceed at rates selected by the operator by adjustment of control valve 31.

Figure 3:
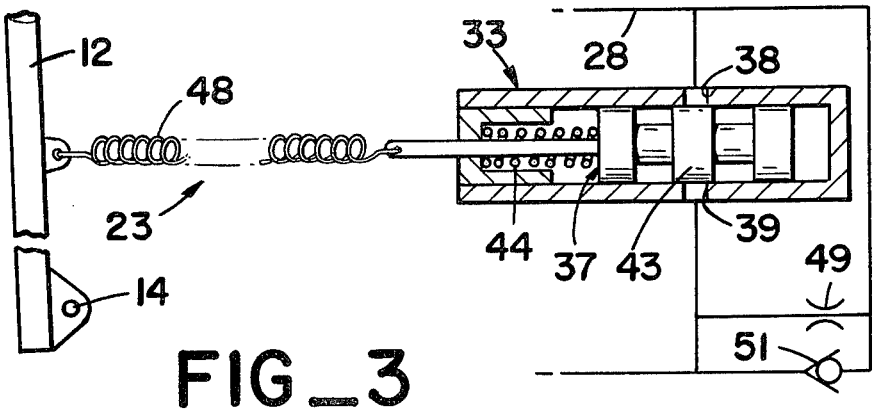
FIG. 3 depicts certain elements of the embodiment of FIG. 2 in shifted positions which occur at another stage of operation.
Figure 4:
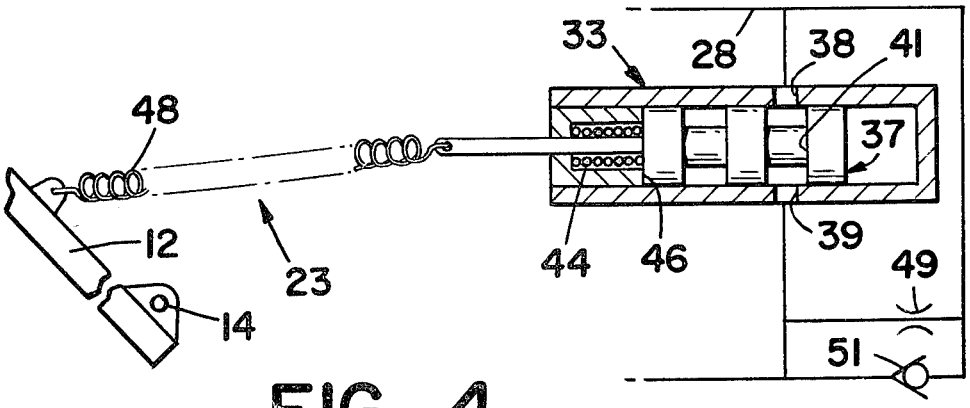
FIG. 4 depicts the structure of FIG. 3 at still another stage of operation.

Referring now to FIG. 3, as the mast 12 is tilted forwardly past the strictly upright or 0° inclination, in this example, spring 48 becomes taut and draws the valve spool 37 leftwardly as viewed in FIG. 3. The central land 43 of the spool 37 then blocks valve ports 38 and 39. The tilt cylinder discharge flow through line 28 must then pass through flow restriction 49 causing a slowing of the flow and a corresponding slowing of the rate of forward tilting movement of the mast 12. When the mast 12 reaches a further degree of forward tilt, at about 5° of forward tilt in this particular example, spring 48 has pulled valve spool 37 sufficiently further to the left, as depicted in FIG. 4, to reestablish an unrestricted flow path via the other groove 41 of the valve spool. Forward tilting motion of the mast 12 past the point at which the valve spool has reached the extreme leftward position as depicted in FIG. 4 results in stretching of the tension spring 48. Thus the further forward tilting of the mast 12 proceeds, from about 5° to about 45° in this example, at a resumed relatively high speed as determined by the operator's setting of the control valve 31.

Accordingly the invention functions to give a positive and reliable signal to the operator when the mast first enters the forward tilt portion of the range of mast inclinations by temporarily reducing the rate of the forward tilting movement.

Slowing of the rate of mast tilting movement does not occur in this embodiment of the invention at any stage during the return or backward tilting movement of the mast 12. Although the flow restrictor valve spool 37 may block valve ports 38 and 39 at a certain stage during the return movement, the flow through line 28 at that time is in a reverse direction from what occurs during forward tilting movement and one way valve 51 opens to provide an unrestricted bypass around the flow restriction 49.

A similar temporary slowing of the rate of forward tilting movement of the mast, during tilting movement through the same portion of the range of mast inclinations is realized by the second embodiment of the invention depicted in FIGS. 5 and 6.

Between the maximum degree of backward tilt of mast 12*a* and the strictly upright position of the mast, cam follower pin 61 is not contacted by cam 59. Under those conditions, lever 53 is held in the horizontal position depicted in FIG. 5 by the internal biasing spring 52 of flow restrictor valve 33*a* and by the compression spring 58. Thus the flow restrictor valve 33*a* is at the first position at which tilting motions of the mast 12*a*, in either direction, may proceed at the rate selected by the operator's setting of the control valve 31*a*.

If a forward tilting movement of the mast 12*a* is continued past the upright or 0° position, surface 62 of cam 59 contacts the pin 61 and then forces the pin upwardly. This pivots lever 53 to draw valve actuator rod 47*a* downward against the force of the internal biasing spring 52 of the valve and the valve is shifted to the second or flow restricting position at which the rate of operation of tilt cylinders 20*a* is slowed.

If the forward tilting of mast 12*a* continues still further, past about 5° of forward inclination in this example, cam follower pin 61 rides off the end of cam surface 62 and the internal biasing spring 52 is then able to restore the flow restrictor valve 33*a* to the first position. This again provides an unrestricted flow path between control valve 31*a* and tilt cylinders 20*a* and the forward tilting motion of the mast 12*a* is thereby accelerated to the rate selected by the setting of the operator's control valve 31*a*.

During the return or backward movement of the mast 12*a* through the 5° to 0° range of forward tilt, cam follower pin 61 is temporarily forced downward by the undersurface 63 of cam 59. This pivots lever 53 in an opposite direction relative to the lever movement during forward tilting. The flow restrictor valve 33*a* is unaffected by the pivoting of lever 53 during the return motion of the mast 12*a* which simply compresses compression spring 58 without affecting the position of valve actuator rod 47*a*. Thus, as in the case of the first embodiment, the temporary slowing of the rate of mast tilting movement at a predetermined portion of the range of mast inclinations occurs only during forward tilting of the mast 12*a*. Return movement of the mast 12*a* may proceed at full speed as the undersurface 63 of cam 59 in conjunction with lever 53 and spring 58 constitute means 50*a* for preventing operation of the speed reducing means 22*a* during the return movement.

Thus the invention in any of its embodiments very positively and unmistakably alerts the operator when the mast first enters the forward portion of the range of mast inclinations. The operator may then terminate the forward tilting when that is desirable but may also continue the forward tilting, if necessary, without any delay or diversion of effort to enable the continued forward tilting.

Other aspects, objects and advantages of this invention can be obtained from a study of the drawings, the disclosure and the appended claims.

I claim:

1. In a load handling vehicle (11) having a tiltable mast (12,12*a*), means (16) for supporting a load on said mast (12,12*a*), and motor means (19) for tilting said mast (12,12*a*) in one direction between a first and a second position and for tilting said mast (12,12*a*) in an opposite direction between said second and first positions, the improvement comprising:

speed reducing means (22,22*a*) for slowing tilting movement of said mast (12,12*a*);

inclination sensing means (23,23*a*) for detecting the inclination of said mast and actuating said speed reducing means (22,22*a*) in response to movement of said mast in said one direction of travel (12,12*a*) within a predetermined range of mast positions located between said first and second positions; and means (50,50*a*) for preventing operation of said speed reducing means (22,22*a*) in response to movement of said mast (12,12*a*) in said opposite direction of travel through said predetermined range of mast positions.

2. The vehicle (11) set forth in claim 1 wherein said predetermined range of mast (12, 12*a*) positions is located away from both said first position and said second position and wherein said inclination sensing means (23, 23*a*) deactuates said speed reducing means (22, 22*a*) after passage of said mast (12, 12*a*) through said predetermined range of mast positions.

3. The vehicle (11) set forth in claim 1 wherein said motor means (19) includes at least one fluid motor (20, 20*a*) connected to said mast (12, 12*a*), a source (27, 27*a*) of pressurized fluid and control valve means (31, 31*a*) for selectively transmitting fluid between said source (27, 27*a*) and said motor (20, 20*a*) at a selectable flow rate, and wherein said speed reducing means (22, 22*a*) includes flow reducing means (32, 32*a*) for reducing the rate of fluid flow between said source (27, 27*a*) and said motor (20, 20*a*) while said speed reducing means (22, 22*a*) is actuated by said inclination sensing means (23, 23*a*).

4. The vehicle (11) set forth in claim 3 wherein said flow reducing means (32, 32*a*) includes a flow restrictor valve (33, 33*a*) having a first position at which said fluid is transmitted between said source (27, 27*a*) and said fluid motor (20, 20*a*) at a selected rate established by said control valve means (31, 31*a*) and having a second position at which said fluid is transmitted between said source (27, 27*a*) and said fluid motor (20, 20*a*) at a reduced rate through a relatively restricted flow path, and wherein said inclination sensing means (23, 23*a*) shifts said flow restrictor valve (33, 33*a*) from said first position thereof to said second position thereof in response to movement of said mast (12, 12*a*) into said predetermined range of mast positions.

5. The vehicle (11) set forth in claim 1 wherein said load handling vehicle (11) is a lift truck, said mast (12, 12*a*) being tilted outward from said lift truck (11) when the mast (12, 12*a*) is at said first position and being tilted inward towards said lift truck (11) when the mast (12, 12*a*) is at said second position, said predetermined range of mast positions being between said first position and a vertical orientation of said mast (12, 12*a*).

6. In a load handling vehicle (11) having a tiltable mast (12,12*a*), means (16) for supporting a load on said mast (12,12*a*), at least one fluid operated tilt cylinder (20,20*a*) connected to said mast (12,12*a*), a source (27,27*a*) of pressurized fluid and means (31,31*a*) for selectively establishing a fluid flow path (28,28*a*) between said tilt cylinder (20,20*a*) and said source (27,27*a*), the improvement comprising:

a flow restrictor valve (33,33*a*) connected into said flow path (28,28*a*) and having a first position at which flow is transmitted through said flow path (28,28*a*) at a first flow rate, a second position at which flow is transmitted through said flow path (28,28*a*) at a relatively smaller rate, and a third position at which said fluid is transmitted between said source (27) and said fluid motor (20) at a rate greater than at said second position of said valve (33), said flow restricting valve (33,33*a*) being biased towards said first position and having an actuator element (47,47*a*) movable a first distance to shift said valve (33,33*a*) to said second position and movable a second greater distance to shift said valve (33,33*a*) to said third position, and inclination sensing means (23,23*a*) for shifting said flow restrictor valve (33,33*a*) from said first position to said second position in response to tilting of said mast (12,12*a*) into an intermediate portion of a range of mast positions and for shifting said flow restrictor valve (33,33*a*) to said third position after passage of said mast (12) through said intermediate portion of said range of mast positions, said inclination sensing means (23,23*a*) includes a tension spring (48) connected between said mast (12,12*a*) and said actuator element (47,47*a*), said tension spring (48) being distendable in response to continual tilting of said mast (12,12*a*) after passage of said mast through said intermediate portion of said range of mast positions.

7. The vehicle (11) set forth in claim 6 further including a flow restriction (49) situated in said flow path (28) at said second position of said flow restrictor valve (33), and one way flow valve means (51) for bypassing fluid flow around said flow restriction (49) when the flow through said flow path (28) is in one direction.

8. In a load handling vehicle (11) having a tiltable mast (12,12*a*), means for supporting a load on said mast (12,12*a*), at least one fluid operated tilt cylinder (20,20*a*) connected to said mast (12,12*a*), a source (27,27*a*) of pressurized fluid and means (31,31*a*) for selectively establishing a fluid flow path (28,28*a*) between said tilt cylinder (20,20*a*) and said source (27,27*a*), the improvement comprising:

a flow restrictor valve (33,33*a*) connected in said flow path (28,28*a*) and having a first position at which flow is transmitted through said flow path (28,28*a*) at a relatively smaller rate, and inclination sensing means (23,23*a*) for shifting said flow restrictor valve (33,33*a*) from said first position to said second position in response to tilting of said mast (12,12*a*) into a predetermined portion of a range of mast positions, said inclination sensing means includes a cam (59) secured to said mast (12*a*), a cam follower (61) positioned to be in contact with said cam (59) and to be shifted thereby as said mast is tilted into said predetermined portion of said range of mast positions, and means (53,57,47*a*) for transmitting motion of said cam follower (61) to said flow restrictor valve (33*a*) to shift said flow restrictor valve to said second position in response to said shifting of said cam follower (61), said means (53,57,47*a*) for transmitting said cam follower (61) motion to said flow restrictor valve (33*a*) includes a pivotal lever (53), extending adjacent the path travelled by said cam (59) as said mast (12*a*) is tilted through said predetermined portion of said range of mast positions, said cam including means (62) for pivoting said lever (53) in a first direction when said mast enters said predetermined portion of said range of mast positions from one side thereof and means (63) for pivoting said lever (53) in an opposite direction when said mast (12*a*) enters said predetermined portion of said range of mast positions from an opposite side thereof, and further including means (47*a*,57,58) for shifting said flow restrictor valve (33*a*) to said second position thereof in response to pivoting of said lever (53) in said first direction only.

* * * * *

UNITED STATES PATENT AND TRADEMARK OFFICE

CERTIFICATE OF CORRECTION

PATENT NO. : 4,459,081

DATED : July 10, 1984

INVENTOR(S) : Jerry L. Reeves

It is certified that error appears in the above-identified patent and that said Letters Patent is hereby corrected as shown below:

On front page of patent, after "Assignee:" delete "Cameron Iron Works, Inc., Houston, Tex." and insert --Towmotor Corporation, Mentor, Ohio--.

On front page of patent, after "Attorney, Agent, or Firm--" delete "Vinson & Elkins" and insert --Alan J. Hickman--.

Signed and Sealed this

*Thirtieth* Day of *April 1985*

[SEAL]

*Attest:*

DONALD J. QUIGG

*Attesting Officer* *Acting Commissioner of Patents and Trademarks*